US007032254B1

(12) United States Patent
Dong et al.

(10) Patent No.: US 7,032,254 B1
(45) Date of Patent: Apr. 25, 2006

(54) PLUG FOR SINK DRAINAGE

(76) Inventors: Weilong Dong, Tianbao Zinc Alloy Manufacturing Co. Ltd., Zhenhai Economic Development Area, Ningbo City, Zhejiang Province, Ningbo, Zhejiang Province (CN) 315200; Hanping Ding, Tianbao Zinc Alloy Manufacturing Co. Ltd., Zhenhai Economic Development Area, Ningbo City, Zhejiang Province, Ningbo, Zhejiang Province (CN) 315200

( * ) Notice: Subject to any disclaimer, the term of this patent is extended or adjusted under 35 U.S.C. 154(b) by 0 days.

(21) Appl. No.: 11/209,999

(22) Filed: Aug. 22, 2005

(30) Foreign Application Priority Data

Apr. 22, 2005 (CN) ..... 200510049655 A

(51) Int. Cl.
*A47K 1/14* (2006.01)

(52) U.S. Cl. ..... 4/295; 4/287
(58) Field of Classification Search ..... 4/286–291, 4/293–295
See application file for complete search history.

(56) References Cited

U.S. PATENT DOCUMENTS

| | | | | |
|---|---|---|---|---|
| 4,908,883 | A * | 3/1990 | Rivera | 4/295 |
| 4,926,507 | A * | 5/1990 | Craig et al. | 4/295 |
| 5,072,461 | A * | 12/1991 | Logsdon | 4/295 |
| 5,758,368 | A * | 6/1998 | Ball | 4/295 |
| 6,067,669 | A * | 5/2000 | Peterson et al. | 4/287 |
| 6,418,570 | B1 * | 7/2002 | Ball | 4/295 |

* cited by examiner

*Primary Examiner*—Tuan Nguyen

(57) ABSTRACT

The present invention discloses an optimized plug for a sink drainage to solve the inferior plug shaft and plug knob structure. The plug shaft and plug knob has two engaging structures, namely, rotating engagement and vertically sliding structure; the plug includes a plug body, a plug shaft, a plug knob, and a plug cap, wherein the plug shaft has side slot defined a top end, the plug knob has a trans-slot, a longitudinal annual channel, and knob shoulder and a biasing bridge slidable inserted into the side slot; by rotating the plug cap from 10° to 170° angular degree, the biasing bridge is supported by the top edge of the plug shaft for ensuring the plug in a water-flowing position, while from 171° to 11° degree, the plug knob is slide into the plug shaft for sealing the water; by inserting an elastic member into the trans-slot, the elastic member is adapted to extend out for biasing the plug shaft edge.

18 Claims, 6 Drawing Sheets

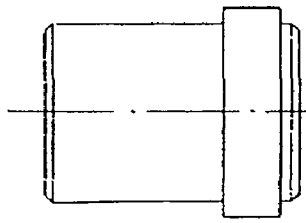
FIG 10
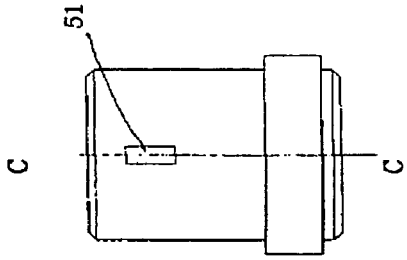
FIG 11
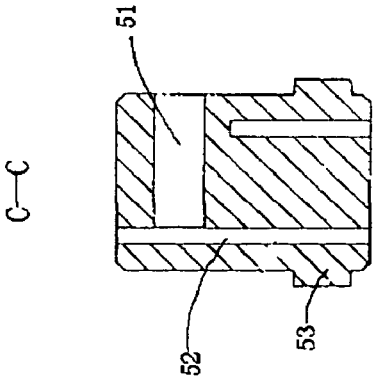
FIG 13
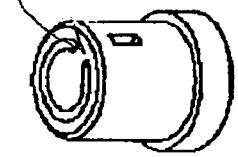
FIG 12
FIG 14

PLUG FOR SINK DRAINAGE

BACKGROUND OF THE PRESENT INVENTION

1. Field of Invention

The present invention relates to a plug for a plumb fixture, such as sink drain, and more particularly, relates to an improved drain plug or a drain stopper to achieve a secure sealing effect.

2. Description of Related Arts

It is seen that sinks of a variety of purposes unexceptionally have a plug to reserve the water therein until washing process is completed. Afterwards, the water contained within the sink could be easily drained off by releasing an engagement between the sink and the plug. For example, the tubs and lavatory in public locations and household facility are equipped with such plugs for preventing water wasting and for managing the washing process.

However, there are considerable drawbacks of such sink-and-plug system in routine practices. One of the notorious problems of such plugs is that they are susceptible to be lost or even be stolen from a public places, thus causing constantly water flowing status of the sinks since no water could be reserved within the sink. As a result, a variety of the plugs are embodied to have a spring-loaded shaft and a connector for slidably coupling such plugs into corresponding drainage. Needless to say, the complicated structure of such spring loaded plug and the connector of such plug would increase the overall costs and worsen the manufacturing procedures. This is due to the fact that the core elements, such as spring-loaded shaft and connector are made of corrosion-proof materials, such as cooper. It is gruesome to imagine the costs of such complicated parts prepared by cooper or other expensive metals.

On the other hand, such plugs utilize its sealing surface biasing against the corresponding sealing surface of the sink to achieve the sealing effect. Unfortunately, the sealing surface of both the sink and the plug, most likely prepared by resilient materials like rubber, would be degraded after a period of extensive service, thus causing undesirable leaking.

SUMMARY OF THE PRESENT INVENTION

A primary object of the present invention is to provide a plug for a sink drainage, wherein the plug comprises a plug body fit into the sink drainage, and a plug stem moveably inserted into the plug body for securely engaging and disengaging the sealing surface respectively defined on the plug body and the plug stem, as a result, a user is able to conveniently maneuver an engagement between the plug stem and the plug body for managing a washing process of the sink.

Another object of the present invention is to provide a plug for a sink drainage, wherein the plug could be easily and securely shifted between a water-sealing position and a water-flowing position.

Another object of the present invention is to provide a plug for a sink drainage, wherein the plug is moveably attached to the sink for ensuring the washing and draining process without resorting to the spring-loaded plug rod or complicated connector.

Another object of the present invention is to provide a plug for a sink drainage, wherein the core elements of the above mentioned plug stem are of hollowed shape so as to save the costly raw materials.

Another object of the present invention is to provide a plug for a sink drainage, wherein no complicated structure or expensive elements are required to achieve above mentioned objects, and the plug could seal the sink drainage with an airtight manner with solid cost saving.

Accordingly, to achieve above mentioned objects, the present invention provides a plug for a sink drainage, comprising:

a hollow plug body fitted into the sink drainage, having an inner platform, and a water stopper attached onto a top surface thereon; and a plug stem moveably engaged with the plug body for shifting the plug between a water-flowing position and a water-sealing position, comprising:

a circular stem body detachably engaged with the water stopper, having a threaded inner wall and a terrace inwardly projected from a lower portion of the inner wall;

an elongated hollow plug shaft penetrating the stem body to be screwed into the said inner platform for coupling the plug stem with the plug body, wherein the plug shaft has a side slot longitudinally defined at a top wall thereof;

a plug knob having a cylinder body, an annular channel longitudinally and upwardly extended from a bottom end of the cylinder body to define an outer wall and an inner core body with the plug knob, a biasing bridge integrally extended between the outer wall and the inner core at an upper portion of the cylinder body, and a knob shoulder circularly flanged from a lower portion of the cylinder body for biasing against the terrace of said circular stem body; and a plug cap for enclosing the plug shaft and the plug knob within the plug stem, comprising a gripping portion and a lower threaded portion which is correspondingly mated with the threaded inner wall of said stem body;

wherein in said water-sealing position, the plug shaft is inserted into the plug knob by receiving the biasing bridge within the side slot, in the water-flowing position, the plug cap is lifted up for pulling the plug knob upwardly shifted along the plug shaft until of the biasing bridge is securely positioned above a top end surface of the plug shaft in a stable manner so as to define a gap between the stem body and the water stopper for draining off the water.

These and other objectives, features, and advantages of the present invention will become apparent from the following detailed description, the accompanying drawings, and the appended claims.

BRIEF DESCRIPTION OF THE DRAWINGS

FIG. 10 is a front view of a plug knob of the plug according to the above first preferred embodiment of the present invention.

FIG. 11 is a side view of the plug knob according to the above first preferred embodiment of the present invention.

FIG. 12 is a top view of the plug knob according to the above first preferred embodiment of the present invention.

FIG. 13 is a sectional view of the plug knob according to the above first preferred embodiment of the present invention showing the annular channel and the trans-slot of the plug knob.

FIG. 14 is a perspective view of the plug knob according to the above first preferred embodiment of the present invention.

DETAILED DESCRIPTION OF THE PREFERRED EMBODIMENT

Figure 1:
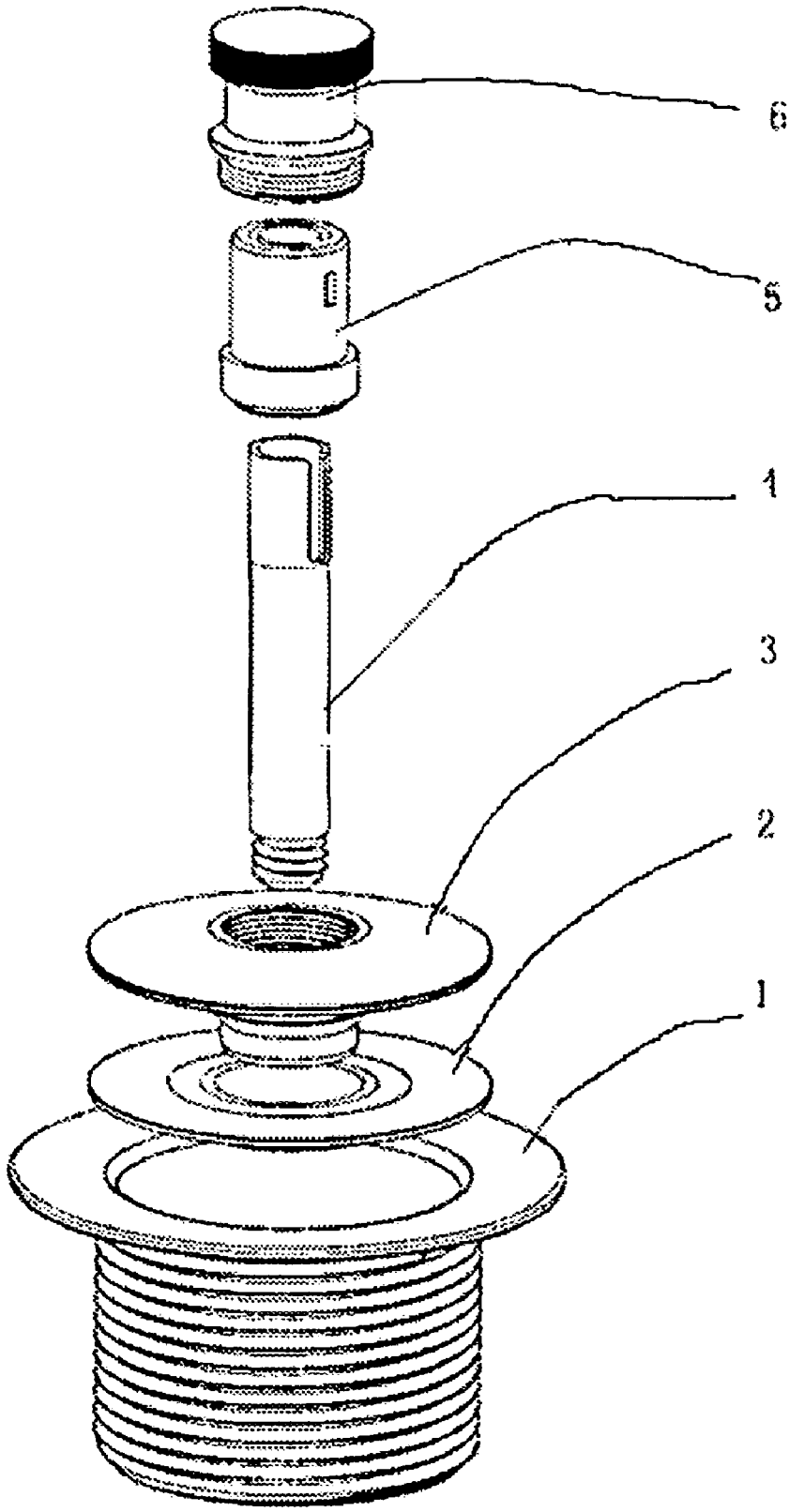
FIG. 1 is an exploded perspective view of a plug for a sink according to a first preferred embodiment of the present invention.
Figure 2:
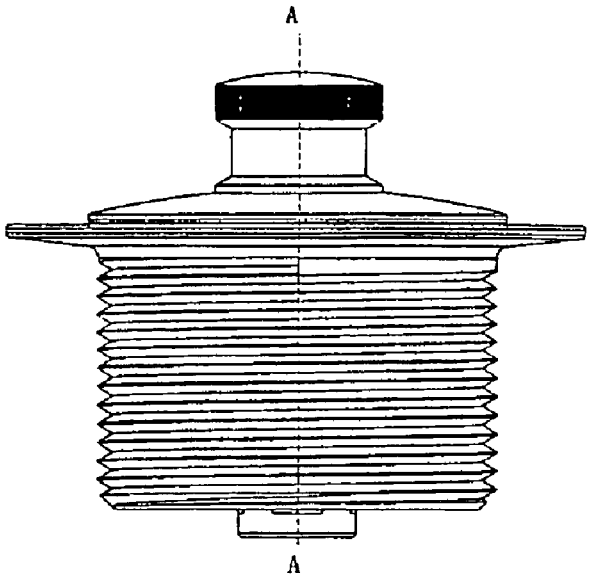
FIG. 2 is a front view of the plug according to above first preferred embodiment of the present invention

Referring to the FIG. 1 to FIG. 18, a plug for a sink drainage according to a first preferred embodiment and a second preferred embodiment of the present invention is illustrated. The first preferred embodiment of the present invention illustrates a sink plug having a rotatable sliding engagement structure for shifting the plug from a water-flowing position and a water-sealing position, while the second preferred embodiment shows a sink plug having a vertical sliding engagement structure for shifting the plug from a water-flowing position and a water-sealing position. The plug comprises a plug body 1 fitted to a sink drainage, a water stopper 2 attached onto the plug body 1, a plug stem having a stem body 3, a plug shaft screwed into the plug body for coupling the plug body 1 to the plug stem, a plug knob 5, and a plug cap 6. According to the rotatable sliding engagement structure, the plug shaft 4 is an elongated hollow cylinder body having a side slot 41 defined at an upper end and a screwed portion defined at a lower end. The plug knob 5 is a cylinder body having a trans-slot 51 defined therein, a longitudinal annual channel 52, a knob shoulder 53 circularly flanged from a lower portion of the plug knob 5, and a biasing bridge 54. Accordingly, the plug body 1 is a hollow container body having a screwed outer wall, a bottom draining opening, an internal platform having a screwed bore which is correspondingly mating with the screwed portion of the plug shaft 4. According to the present invention, the biasing bridge 54 is slidably inserted into the side slot 41 for achieving a sliding engagement between the plug knob 5 and the plug shaft 4. The upper portion of the plug shaft 4 where the side slot is defined is vertically and slidably engaged with the plug knob 5. That is to say, the annual channel 52 is sleeved onto the upper portion of the plug shaft 4. Furthermore, the stem body 3 has a terrace wherein the knob shoulder 53 is supported thereon and has a screwed inner hole for correspondingly coupling to the plug cap 6. Here, the plug cap 6 has a male thread formed around a lower portion of the plug cap 6 whereby a female thread formed at the inner hole of the stem body 3. It is worth to mention that the water stopper 2 is attached onto the plug body 1 for sealedly separating the plug cover and the plug body 1 in a water-tight manner.

According to the second preferred embodiment, there is a positioning elastic member 7 provided within an inner cavity of the plug knob 5. Moreover, a retaining collar 8 is disposed at a joint portion between the stem body 3 and the plug shaft 4 for ensuring the water drained off from a predetermined orientation.

Finally, the plug body 1 further comprises at least two reinforcement bars 11 defined at the bottom side wherein the draining opening 12 is formed between different reinforcement bars. When the plug is shifted to a water draining position, water is adapted to be drained off from the bottom opening 12.

Accordingly, based on the preferred embodiment of the present invention, the plug shaft and the plug knob structure is optimized, the water draining process is orientated in a rational manner.

Figure 3:
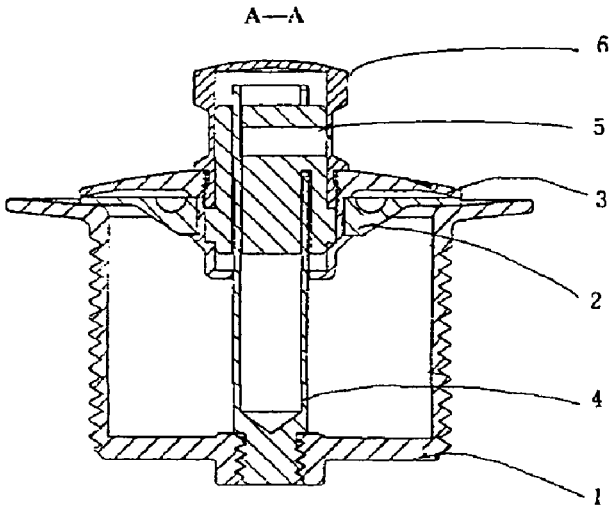
FIG. 3 is a sectional view of the plug according to the above first preferred embodiment of the present invention.
Figure 4:
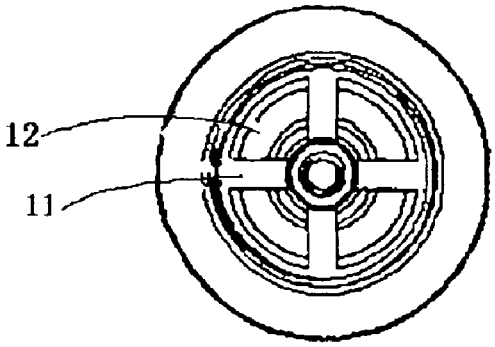
FIG. 4 is a bottom view of the plug according to the above first preferred embodiment of the present invention showing the bottom opening for draining off the water.
Figure 9:
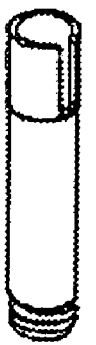
FIG. 9 is a perspective view of the plug shaft according to the above first preferred embodiment.
Figure 8:
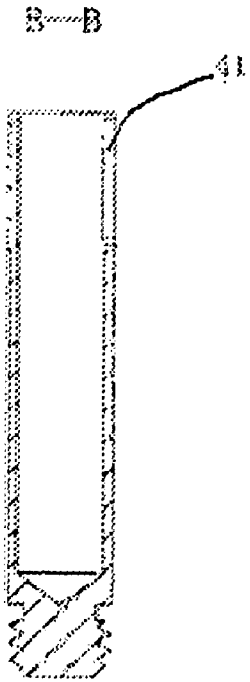
FIG. 8 is a sectional view of the plug shaft according to the above preferred embodiment of the present invention.
Figure 6:
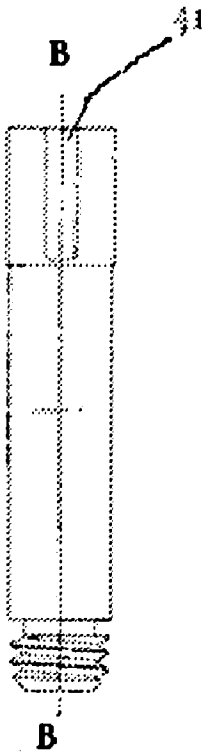
FIG. 6 is a side view of the plug shaft of the plug according to the above preferred embodiment of the present invention illustrating a side slot is defined at a top end of the plug shaft.
Figure 5:
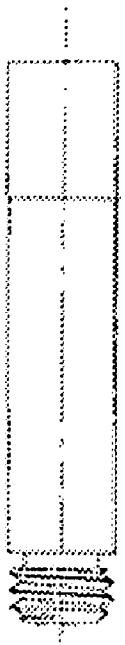
FIG. 5 is a front view of a plug shaft of the plug according to the above first preferred embodiment of the present invention.
Figure 7:
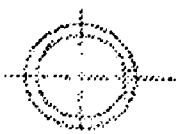
FIG. 7 is a top view of the plug shaft according to the above preferred embodiment of the present invention.
Figure 15:
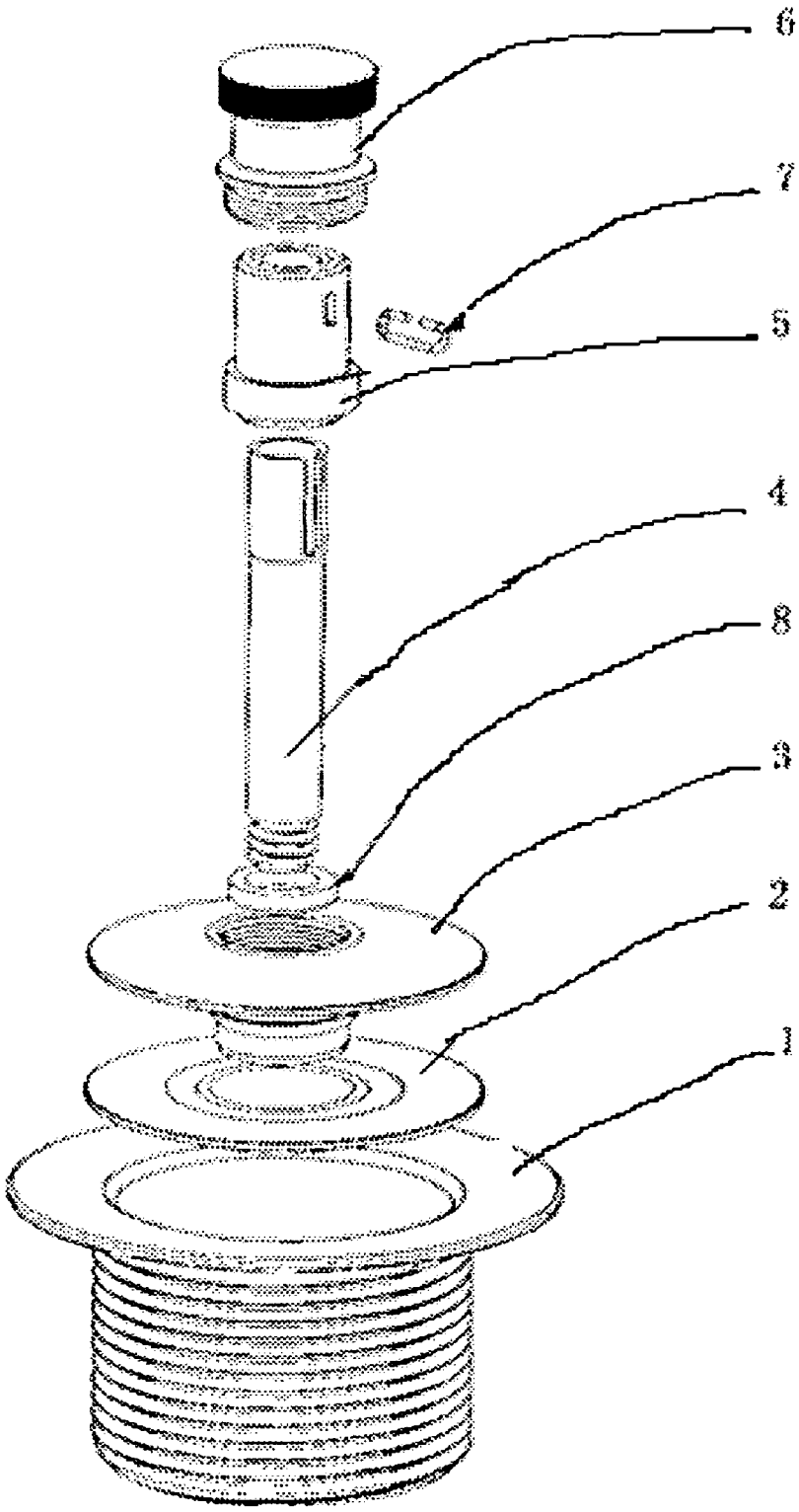
FIG. 15 is an exploded perspective view of a plug for a sink according to a second preferred embodiment of the present invention.

The plug according to the first preferred embodiment of the present invention is shown in FIG. 1 to FIG. 14, wherein biasing bridge 54 of the plug knob 5 is correspondingly matching with the side slot 41 defined onto the plug shaft 4 to be vertically shifted along the slide slot 41. As shown in FIG. 3, the plug cap 6 is a hollow body shaped having a rotating grip defined on an upper outer wall and a male thread defined at a lower outer wall, wherein the threaded outer wall is mated with the female thread provided at the inner terrace of the stem body 3 for screwing the water cap 6 into the stem body 3. After the plug shaft 4 is screwed into the plug body 1 for securely coupling the plug shaft 4 with the plug body 1, a user is able to lift up the plug cap 6 until a bottom end of the biasing bridge 54 of the plug knob 5 is horizontally aligned with the top end surface of the side slot 41 of the plug shaft 4, afterwards, the plug cap 6 could be rotated within a predetermined angular range, preferably from 10° to 170°, the plug knob 5 would be securely nestled onto the plug shaft 4 for guaranteeing the stem body 3 disengaged with the water stopper 2 so as to generate a water-flowing position of such plug. In the water-flowing position, water is capable of draining off via the bottom opening 12 of the plug body 1. On the other hand, if the plug cap 6 is further rotated out of the predetermined angular range, i.e. from 10° to 170°, the plug of the present invention will be shift to a water-sealing position. In the water-sealing position, the biasing bridge 54 of the plug is slidably inserted into the side slot 41 of plug shaft 4, the trans-slot 51 and the C-shaped annular channel 52 of the plug knob 5 are off-limited with the water. Moreover, the weight of the plug cap 6 and the plug knob 5 as well as the suction force of the water flowing process and sealing force of the water stopper 2 would further secure the sealing effect of such plug.

Figure 17:
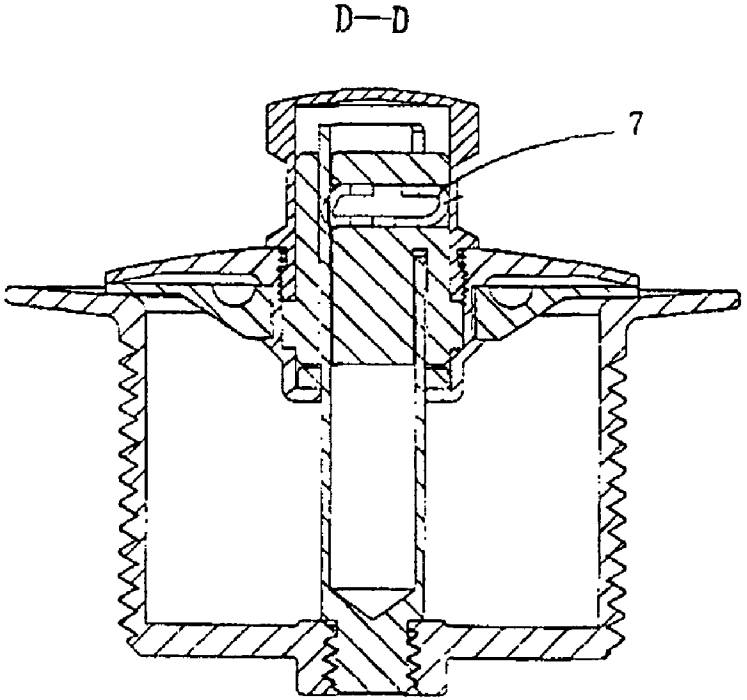
FIG. 17 is a sectional view of the plug according to the above second preferred embodiment of the present invention.
Figure 18:
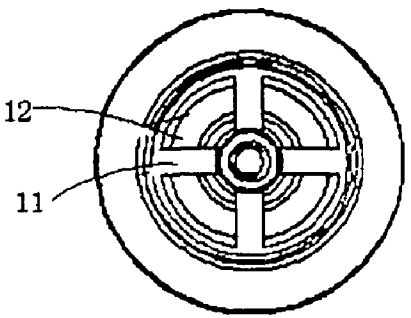
FIG. 18 is a bottom view of the plug according to the above second preferred embodiment of the present invention.
Figure 16:
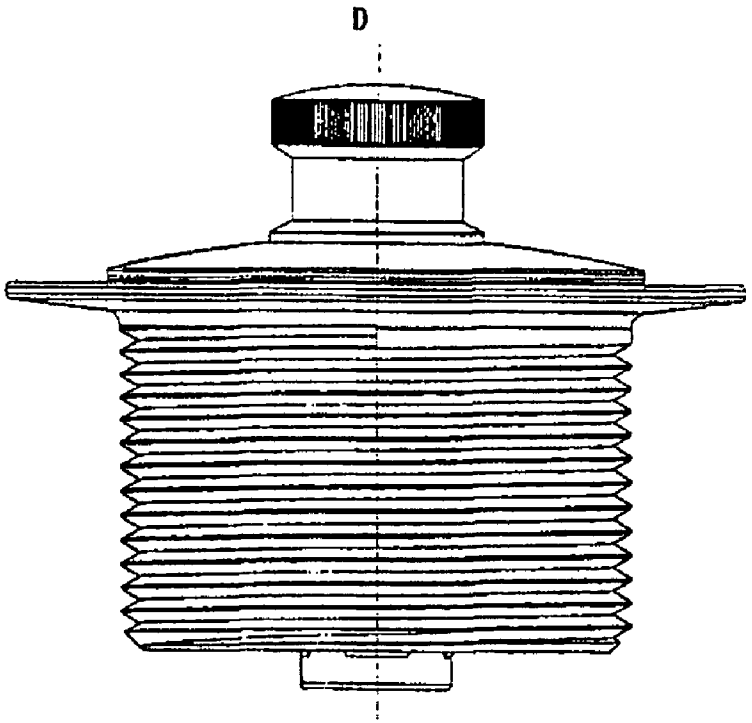
FIG. 16 is a first view of the plug according to the above second preferred embodiment of the present invention.

As shown in FIG. 17, a plug according to the second preferred embodiment of the present invention is illustrated wherein the positioning elastic member 7 depressedly received within the trans-slot 51 is vertically aligning with the side slot 41 of the plug shaft 4. When the plug cap 6 is lifted up, the plug shaft 4 will be upwardly shifted as well. Once the trans-slot 51 is positioned above the top end surface of the plug shaft 4, the positioning elastic member 7 will be further extended out of the trans-slot 51 to be biasing against the edge of the plug shaft 41. As a result, the plug knob 5 will be disposed above the plug shaft 4 thus enabling the stem body 3, the water stopper 2 disengaged with the plug body 1 so as to ensure the plug of the present invention maintained at the water-flowing position. On the other hand, when the plug cap 6 is downwardly depressed, the positioning elastic member 7 will be deformed and pressed into the trans-slot 51 for ensuring the plug knob 5 slidably inserted into the side slot 41 of the plug shaft 4 so as to shift the plug from the water-flowing position to the water-sealing position.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A plug for a sink drainage, comprising:

a hollow plug body fitted into said sink drainage, having an inner platform, and a water stopper attached onto a top surface thereon; and a plug stem moveably engaged with said plug body for shifting said plug between a water-flowing position and a water-sealing position, comprising:

a circular stem body detachably engaged with said water stopper, having a threaded inner wall and a terrace inwardly projected from a lower portion of said inner wall;

an elongated hollow plug shaft penetrating said stem body to be screwed into said inner platform for coupling said plug stem with said plug body, wherein said plug shaft has a side slot longitudinally defined at a top wall thereof;

a plug knob having a cylinder body, an annular channel longitudinally and upwardly extended from a bottom end of said cylinder body to define an outer wall and an inner core body with said plug knob, a biasing bridge integrally extended between said outer wall and said inner core at an upper portion of said cylinder body, and a knob shoulder circularly flanged from a lower portion of said cylinder body for biasing against said terrace of said circular stem body; and a plug cap for enclosing said plug shaft and said plug knob within said plug stem, comprising a gripping portion and a lower threaded portion which is correspondingly mated with said threaded inner wall of said stem body;

wherein in said water-sealing position, said plug shaft is inserted into said plug knob by receiving said biasing bridge within said side slot for ensuring said stem body and said water stopper engaged with a water-tight manner, in said water-flowing position, said plug cap is lifted up for pulling said plug knob upwardly shifted along said plug shaft until of said biasing bridge is securely positioned above a top end surface of said plug shaft in a stable manner so as to define a gap between said stem body and said water stopper for draining off said water.

2. The plug, as recited in claim 1, wherein said plug cap is lifted up until a bottom end of said biasing bridge of said plug knob is horizontally aligned with said top end surface of said side slot of said plug shaft, wherein said plug cap is adapted to be rotated within a predetermined angular range for ensuring said biasing bridge supported by a top edge of said plug shaft.

3. The plug, as recited in claim 2, wherein said plug knob further has a trans-slot defined at said cylinder body penetrating said biasing bridge and said inner core for communicating said annual channel to outside via said outer wall.

4. The plug, as recited in claim 3, further comprising a positioning elastic member received within said trans-slot, in said water-flowing position, said plug cap is lift up, said plug shaft is upwardly shifted enabling said trans-slot positioned above said top end surface of said plug shaft, said positioning elastic member is extended out of said trans-slot to be biasing against a top edge of said plug shaft for ensuring said biasing bridge supported by said plug shaft to define said gap between said stem body and said water stopper, in said water-sealing position, said plug knob is downwardly depressed, said positioning elastic member is deformed and pressed into said trans-slot for ensuring said plug knob slidably inserted into said side slot.

5. The plug, as recited in claim 4, wherein said plug body further comprises at least two reinforcement bars defined at a bottom end of said plug body and a bottom opening formed between said reinforcement bars for draining off water in said water-flowing position.

6. The plug, as recited in claim 5, further comprising a retaining collar disposed at a joint portion between said stem body and said plug shaft for ensuring said side slot of said plug shaft secured at a predetermined orientation.

7. The plug, as recited in claim 5, wherein said predetermined angular range is from 10° to 170°.

8. The plug, as recited in claim 4, wherein said predetermined angular range is from 10° to 170°.

9. The plug, as recited in claim 3, wherein said predetermined angular range is from 10° to 170°.

10. The plug, as recited in claim 2, wherein said plug body further comprises at least two reinforcement bars defined at a bottom end of said plug body and a bottom opening formed between said reinforcement bars for draining off water in said water-flowing position.

11. The plug, as recited in claim 10, further comprising a retaining collar disposed at a joint portion between said stem body and said plug shaft for ensuring said side slot of said plug shaft secured at a predetermined orientation.

12. The plug, as recited in claim 2, wherein said predetermined angular range is from 10° to 170°.

13. The plug, as recited in claim 1, wherein said plug knob further has a trans-slot defined at said cylinder body penetrating said biasing bridge and said inner core for communicating said annual channel to outside via said outer wall.

14. The plug, as recited in claim 13, further comprising a positioning elastic member received within said trans-slot, in said water-flowing position, said plug cap is lift up, said plug shaft is upwardly shifted enabling said trans-slot positioned above said top end surface of said plug shaft, said positioning elastic member is extended out of said trans-slot to be biasing against a top edge of said plug shaft for ensuring said biasing bridge supported by said plug shaft to define said gap between said stem body and said water stopper, in said water-sealing position, said plug knob is downwardly depressed, said positioning elastic member is deformed and pressed into said trans-slot for ensuring said plug knob slidably inserted into said side slot.

15. The plug, as recited in claim 14, wherein said plug body further comprises at least two reinforcement bars defined at a bottom end of said plug body and a bottom opening formed between said reinforcement bars for draining off water in said water-flowing position.

16. The plug, as recited in claim 15, further comprising a retaining collar disposed at a joint portion between said stem body and said plug shaft for ensuring said side slot of said plug shaft secured at a predetermined orientation.

17. The plug, as recited in claim 1, wherein said plug body further comprises at least two reinforcement bars defined at a bottom end of said plug body and a bottom opening formed between said reinforcement bars for draining off water in said water-flowing position.

18. The plug, as recited in claim 1, further comprising a retaining collar disposed at a joint portion between said stem body and said plug shaft for ensuring said side slot of said plug shaft secured at a predetermined orientation.

* * * * *